US005213334A

United States Patent [19]

Yih

[11] Patent Number: 5,213,334

[45] Date of Patent: May 25, 1993

[54] DECK OF CARDS HAVING TEN SETS OF SIX CARDS AND SPECIALTY CARDS

[76] Inventor: Lee F. Yih, 23CD Cliffview Mansion, 21-23 Conduit Road, Hong Kong, Hong Kong

[21] Appl. No.: 842,558

[22] Filed: Feb. 27, 1992

Related U.S. Application Data

[62] Division of Ser. No. 549,028, Jul. 6, 1990, Pat. No. 5,106,100.

[51] Int. Cl.[5] ..... A63F 1/00

[52] U.S. Cl. ..... 273/292; 273/306; 273/308

[58] Field of Search ..... 273/292, 297, 303, 304, 273/305, 306, 307, 308; 434/219

[56] References Cited

U.S. PATENT DOCUMENTS

| | | | |
|---|---|---|---|
| 742,498 | 3/1903 | Roy | 273/299 |
| 848,542 | 3/1907 | Ferris | 273/306 |
| 1,117,316 | 11/1914 | Booton | 273/306 |
| 1,554,834 | 9/1925 | Babcock | 273/306 |
| 4,071,247 | 1/1978 | Breslow | 273/308 |
| 4,294,451 | 10/1981 | Wollner | 273/308 |
| 4,480,840 | 11/1984 | Chang | 273/292 |
| 4,807,885 | 2/1989 | Chamblee et al. | 273/292 |
| 4,836,553 | 6/1989 | Suttle et al. | 273/292 |
| 4,846,480 | 7/1989 | Oliver | 273/292 |

OTHER PUBLICATIONS

UNO Instructions, International Games Inc.

"Fads-The Card Games Executives Play" Aisaweek, (Feb. 1991).

Hong Kong Enterprise, "New Deal for Old Card Game".

*Primary Examiner*—V. Millin

*Assistant Examiner*—William M. Pierce

*Attorney, Agent, or Firm*—Burns, Doane, Swecker & Mathis

[57] ABSTRACT

A card game for play by a plurality of players in which players play groups of cards that include one or more cards. The card game includes a set of first cards, in which each card has first designating indicia on one face for designating a hierarchical ranking of the cards in each set relative to the other sets of cards and second designating indicia on the one face for designating, as between groups of cards having the same first designating indicia, the higher ranking played group. The deck of cards also includes four additional cards, each of which has first designating indicia on one face for designating the hierarchal rank of those cards relative to the sets of first cards. According to the method of play, the cards are dealt to the players and the first player plays one or more cards within certain defined categories of cards. Each subsequent player must then play a card or cards of higher rank within the category that was led. Players continue to play cards until one player depletes his hand of cards, whereby that player is declared the winner of that hand. In the next hand, the loser of the previous hand must give his highest ranking card to the winner of the previous hand while the winner gives any card of his choice to the loser.

16 Claims, 5 Drawing Sheets

| CARD RANK* | NAME | NUMBER OF CARDS AND SUITS |
|---|---|---|
| 1 | Students | (Six) 2 red, 2 yellow, 2 blue |
| 1+ | Student Leader | (One) 1 multi-suit |
| 2 | Farmers | (Six) 2 red, 2 yellow, 2 blue |
| 3 | Soldiers | (Six) 2 red, 2 yellow, 2 blue |
| 4 | Factory Workers | (Six) 2 red, 2 yellow, 2 blue |
| 5 | Clerks | (Six) 2 red, 2 yellow, 2 blue |
| 6 | Teachers | (Six) 2 red, 2 yellow, 2 blue |
| 7 | Doctors | (Six) 2 red, 2 yellow, 2 blue |
| 8 | Bureaucrats | (Six) 2 red, 2 yellow, 2 blue |
| 9 | Mayors | (Six) 2 red, 2 yellow, 2 blue |
| 10 | Generals | (Six) 2 red, 2 yellow, 2 blue |
| VP | Vice-Premiers | (Two) N/A |
| C | Chairman | (One) N/A |

* from lowest to highest

| CARD RANK* | NAME | NUMBER OF CARDS AND SUITS |
|---|---|---|
| 1 | Students | (Six) 2 red, 2 yellow, 2 blue |
| 1+ | Student Leader | (One) 1 multi-suit |
| 2 | Farmers | (Six) 2 red, 2 yellow, 2 blue |
| 3 | Soldiers | (Six) 2 red, 2 yellow, 2 blue |
| 4 | Factory Workers | (Six) 2 red, 2 yellow, 2 blue |
| 5 | Clerks | (Six) 2 red, 2 yellow, 2 blue |
| 6 | Teachers | (Six) 2 red, 2 yellow, 2 blue |
| 7 | Doctors | (Six) 2 red, 2 yellow, 2 blue |
| 8 | Bureaucrats | (Six) 2 red, 2 yellow, 2 blue |
| 9 | Mayors | (Six) 2 red, 2 yellow, 2 blue |
| 10 | Generals | (Six) 2 red, 2 yellow, 2 blue |
| VP | Vice-Premiers | (Two) N/A |
| C | Chairman | (One) N/A |

* from lowest to highest

*FIG. 16*

DECK OF CARDS HAVING TEN SETS OF SIX CARDS AND SPECIALTY CARDS

This application is a divisional of application Ser. No. 07/549,028, filed Jul. 6, 1990 now U.S. Pat. No. 5,106,100.

FIELD OF THE INVENTION

The present invention relates to a game and more particularly, to a card game that can be played by a plurality of players.

BACKGROUND AND SUMMARY OF THE INVENTION

Many different types of card games have been proposed in an attempt to provide a game that requires skill and strategy and that is exciting and challenging. For example, U.S. Pat. No. 4,071,247 to Breslow discloses a card game of a semi-political nature which employs a deck of cards having a total of seventy-two cards. The seventy-two cards are divided into a set of seven flag cards, each of which has the representation of a flag of a particular country on its face. A set of general cards is also provided for each of the countries represented on the flags. The general cards associated with each country have numbers on the faces thereof indicating the order of rank of the respective general cards in each set. A plurality of additional cards is also provided. A portion of the cards in the deck is dealt to the players, and according to the rules of play, players can attempt to improve their hand by discarding cards from their hand and picking new cards from the remaining stack of cards. The order of rank of the various nations is determined according to the order in which the flag cards are played, the first played flag card representing the highest order nation and the last played flag card representing the lowest ranking nation. Thereafter, players play the general cards in their hand in an attempt to win tricks. The player who plays the general card of the highest ranking nation wins the trick, and if two players play general cards of the same rank, the winner of the trick is the person playing the general card having the highest ranking numerical indicia on its face.

In another game, U.S. Pat. No. 4,480,840 to Chang, a deck of cards which includes two kinds of cards, celestial cards and terrestrial cards, is employed. The celestial cards are divided into three different suits (the sun suit, the moon suit and the star suit), and the terrestrial cards are also divided into three suits (the club suit, the bamboo suit and the pine suit). The six suits are ranked according to a particular hierarchy. The cards are used to play a game of Chinese poker according to a set of rules set forth in the patent.

There is also the known game of "UNO" which is played with a deck of cards consisting of 108 cards. Nineteen of the cards numbered zero through nine are blue in color, nineteen of the cards numbered zero through nine are green in color, nineteen of the cards numbered zero through nine are red in color, and nineteen of the cards numbered zero through nine are yellow in color. The deck also includes eight cards marked "Draw Two", two of which are blue, two of which are green, two of which are red, and two of which are yellow; eight cards marked "Reverse", two of which are blue, two of which are green, two of which are red, and two of which are yellow; and eight cards marked "Skip", two of which are blue, two of which are green, two of which are red, and two of which are yellow. Also, the deck of cards includes four cards marked "Wild" and four cards marked with the designation "Wild Draw Four". Each player is dealt seven cards, and the remaining cards are placed face down to form a draw pile. After the first card is turned over from the draw pile each player in turn must play a card from his hand by matching either the color, the number, or the word description of the last played card. If a player cannot match a card, he must draw cards from the draw pile until he obtains a card that he can play.

In a game that is known in China and termed "Choh, Daih, Di", players utilize a standard deck of cards which consists of fifty-two cards divided into thirteen sets of four cards each.

While the foregoing games do provide a certain amount of amusement and entertainment, the amount of skill and strategy involved in playing the game is rather limited. As a consequence, there exists a need for a card game that requires skill and strategy but which is exciting, interesting, and not complicated to play, thereby appealing to an audience that includes children as well as adults.

There also exists a need for a game that provides an element of unpredictability for creating surprises and for lessening the intensity of the game. In other types of game which do not employ wild cards, the players can readily predict the strength of the cards in their hands by keeping track of the cards played. Thus, those games can be quite intense in that players know when they will be able to prevail with a particular hand.

The use of wild cards changes all of that because a player is never really certain that the cards he has in his hand are higher than the cards in the hands of the other players. As a result, an element of surprise always exists, and the game tends to be more exciting and less intense.

There also exists a need for a game that provides additional incentive to the players to avoid losing and to seek to win. In many types of games, the rules are such that the loser of the game is given some benefit or advantage over the other players in subsequent games in order to make the game more fair. However, in reality, things are not always fair, as is recognized by the often used saying "who said life is fair".

By providing a game that affords advantages to the winner and disadvantages to the loser, the stronger tend to get stronger while the weaker tend to get weaker. Thus, the players are presented with quite a challenge. The loser of a particular hand has great incentive to avoid continually losing because of the disadvantages associated with losing and because additional losses will set him back further. Moreover, with the advantages that are afforded to the winner, the loser of a hand is challeged to start winning so that he can catch up. In the same manner, the winner of a particular hand has incentive to continue winning and avoid losing.

It would also be desirable to provide a game having the foregoing features and having a Chinese background or theme.

SUMMARY OF THE INVENTION

To achieve the foregoing objectives, as well as other objectives, the card game of the present invention includes a deck of cards having a plurality of first cards which are divided into a plurality of sets such that each set contains a plurality of cards. Each of the cards has first designating indicia on one face thereof for designating each card as being a member of a particular set and for designating a rank of the card relative to the cards in other sets. All of the cards within a particular set have the same first designating indicia so that all of the cards within a set have the same rank relative to cards in other sets and so that the sets of cards are ranked in a hierarchical order. Each of the first cards also has second designating indicia on the one face thereof which is associated with a particular rank. Some of the cards within a respective set have different second designating indicia on the face thereof, and the different second designating indicia have different ranks associated therewith.

In a preferred embodiment of the present invention, the card game includes ten sets of cards, each set having six cards. The deck also includes one second card, two third cards, and a fourth card. The second, third and fourth cards also have first designating indicia on the face thereof for designating a hierarchical ranking of those cards relative to the other sets of cards.

The method of playing the game includes the steps of dealing at least some of the cards to the players and having one of the players play one or more cards from his hand that fall within several categories. The categories include single cards, pairs of cards, three-of-a-kind, four-of-a-kind, or five card combinations such as straights, flushes and full-houses. Each subsequent player who chooses to play cards must play a card or cards from his hand that is of the same category of cards as first led, but of a higher rank. Alternatively, players can play cards from a category of cards that are designated as wild.

In the preferred embodiment, players can choose to pass and not play any cards from their hands, and after all of the players have passed, the player to last play cards can play a card or cards from his hand from the same category last played or from a different category. The hand ends when one of the players depletes all of the cards in his hand. The players with cards remaining in their hands at the end of the hand are then assessed points depending upon the number of cards remaining in their respective hands. The next hand is begun by dealing all of the cards and having the loser of the previous hand give to the winner of the previous hand the highest card in his hand while also having the winner of the previous hand give any card of his choice to the loser of the previous hand.

BRIEF DESCRIPTION OF THE DRAWING

Preferred embodiments of the present invention will now be described in greater detail with reference to the accompanying drawing wherein like elements bear like reference numerals and wherein:

FIG. 16 is table which sets forth the cards used in the card game of the present invention.

DETAILED DESCRIPTION OF THE PREFERRED EMBODIMENTS

The card game of the present invention is entitled "Gang of Four" for reasons which will become apparent from the description that follows.

The card game includes a deck of cards and preferably a score pad. In the preferred embodiment, the deck of cards consists of sixty-four cards. The sixty-four cards are divided into ten sets of first cards, a second card, two third cards, and a fourth card.

Figure 1:
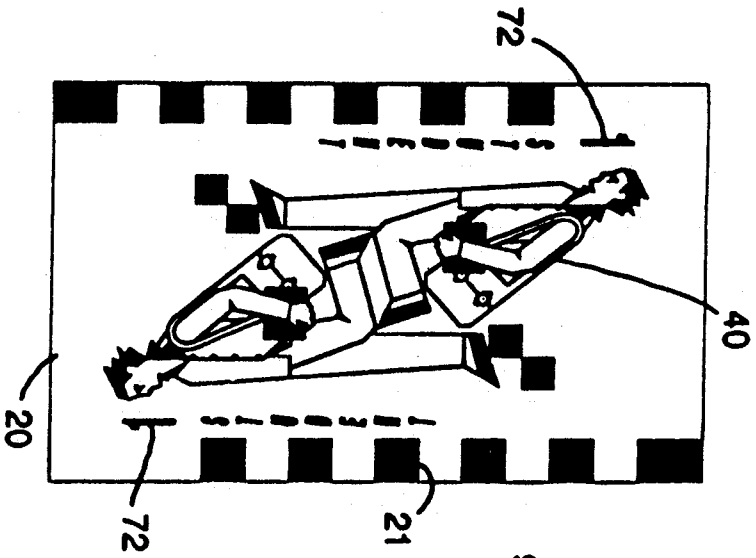
FIG. 1 is a plan view of the front face of one type of card used in the card game of the present invention.
Figure 3:
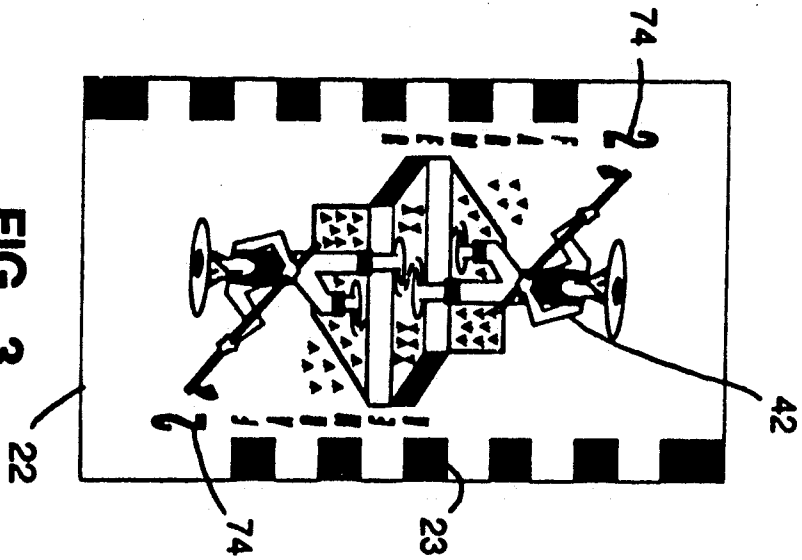
FIG. 3 is a plan view of the front face of a third type of card used in the card game of the present invention.
Figure 4:
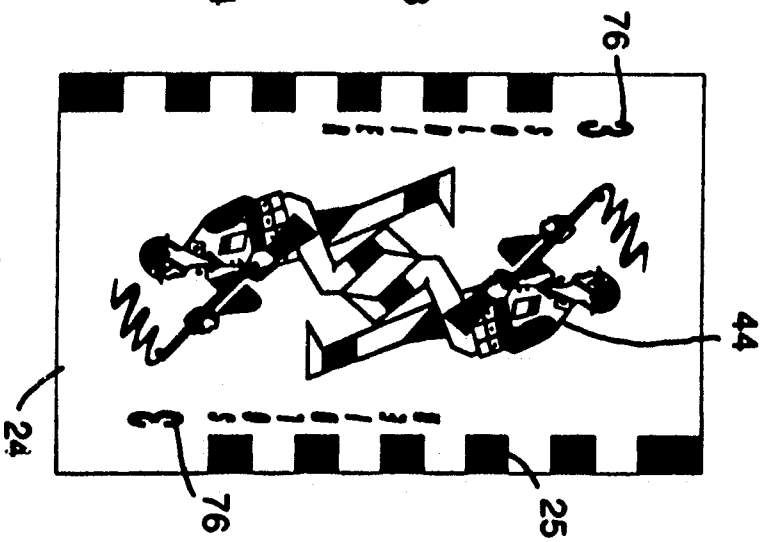
FIG. 4 is a plan view of the front face of a fourth type of card used in the card game of the present invention.
Figure 5:
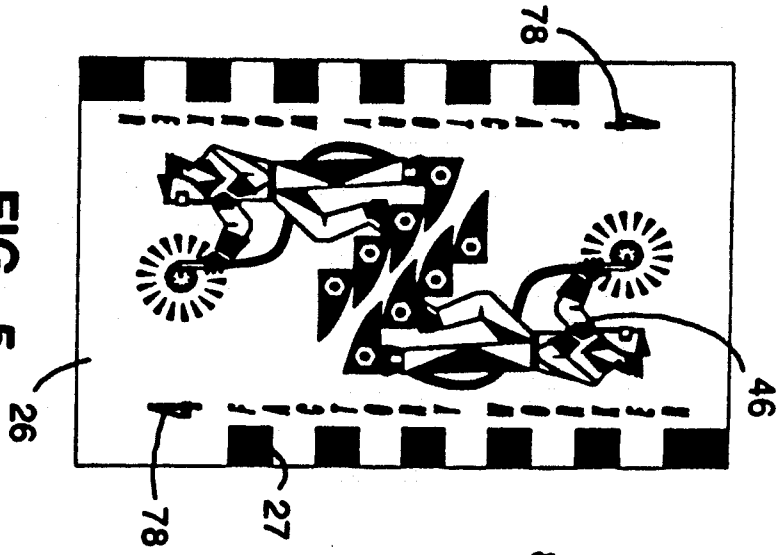
FIG. 5 is a plan view of the front face of a fifth type of card used in the card game of the present invention.
Figure 6:
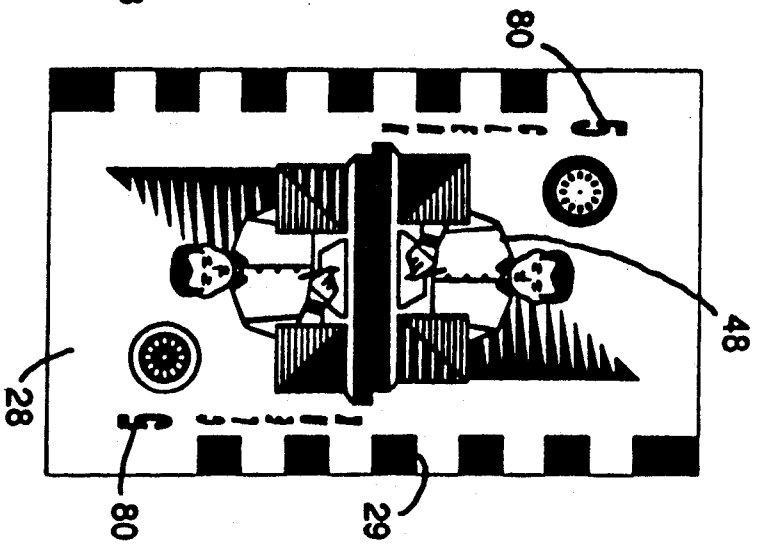
FIG. 6 is a plan view of the front face of a sixth type of card used in the card game of the present invention.
Figure 7:
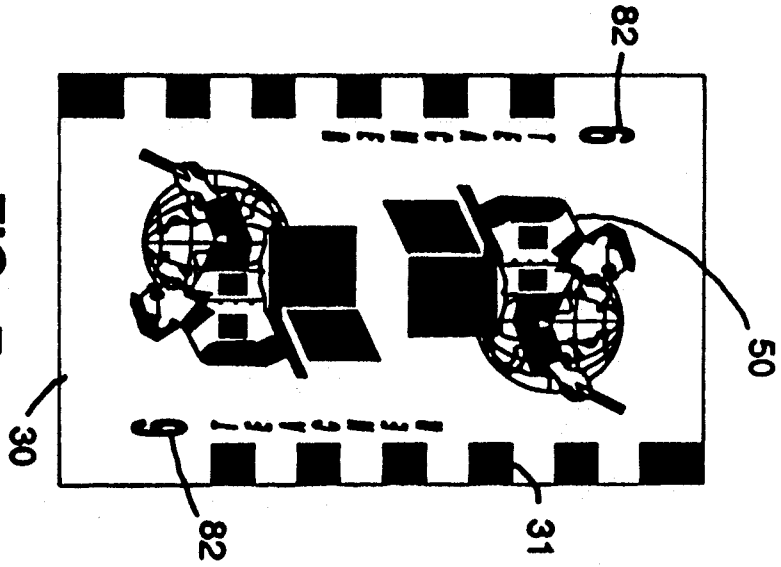
FIG. 7 is a plan view of the front face of a seventh type of card used in the card game of the present invention.
Figure 8:
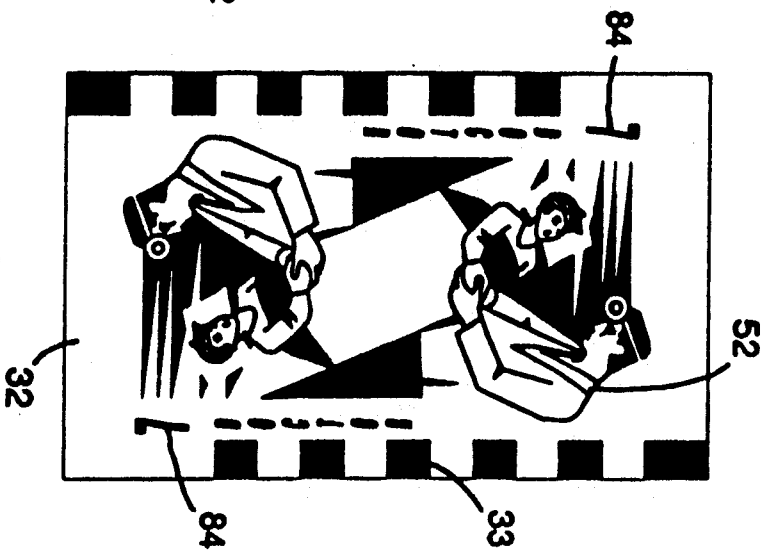
FIG. 8 is a plan view of the front face of an eighth type of card used in the card game of the present invention.
Figure 9:
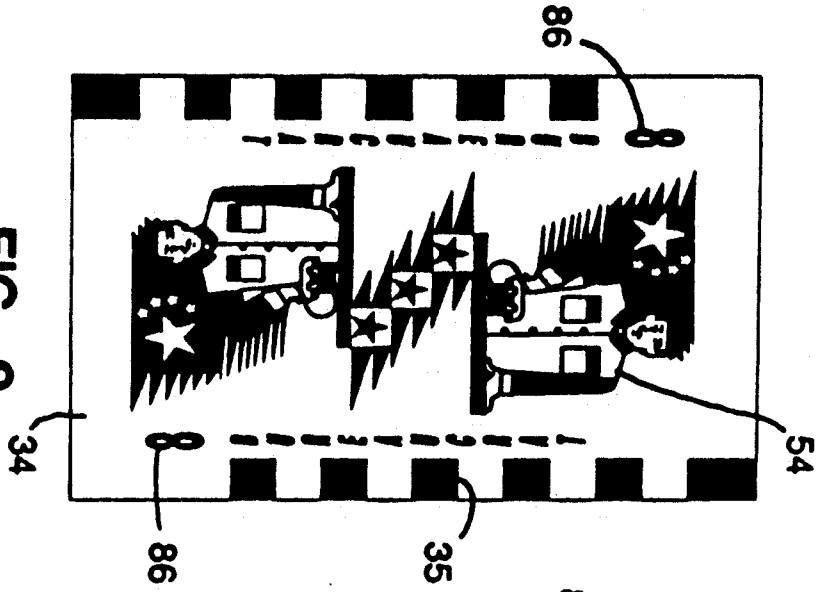
FIG. 9 is a plan view of the front face of a ninth type of card used in the card game of the present invention.
Figure 10:
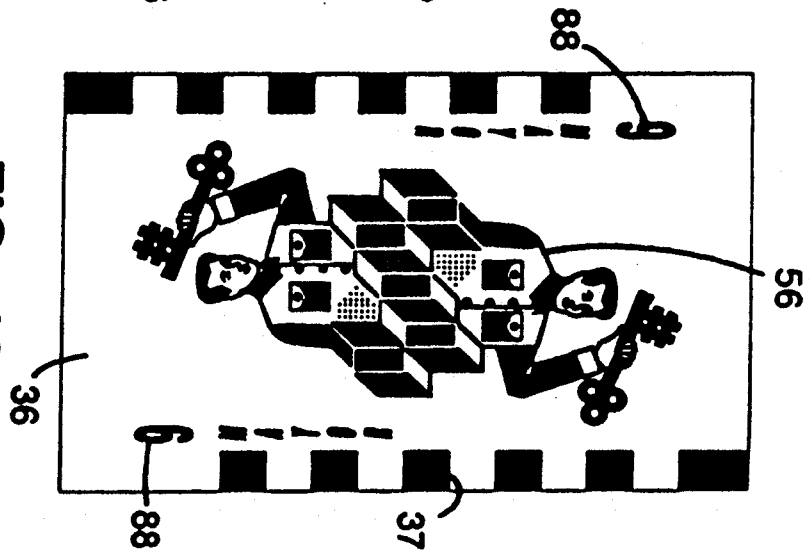
FIG. 10 is a plan view of the front face of a tenth type of card used in the card game of the present invention.
Figure 11:
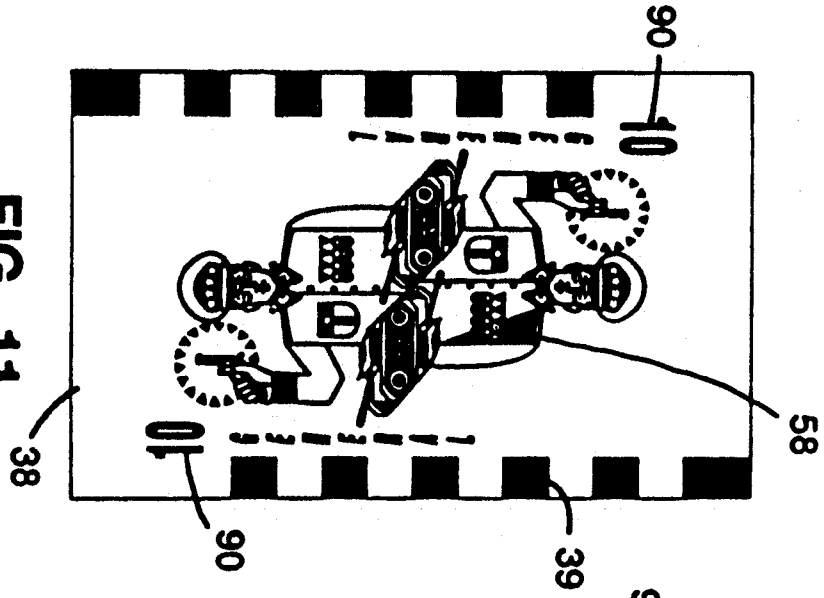
FIG. 11 is a plan view of the front face of an eleventh type of card used in the card game of the present invention.

Each of the ten sets of first cards includes six cards, and each set of cards is preferably associated with a particular occupation. The ten sets of cards include: six cards 20 designated student, one of which is shown in FIG. 1; six cards 22 designated farmer, one of which is depicted in FIG. 3; six cards 24 designated soldier, one of which is illustrated in FIG. 4; six cards 26 designated factory worker, one of which is shown in FIG. 5; six cards 28 designated clerk, one of which is illustrated in FIG. 6; six cards 30 designated teacher, one of which is shown in FIG. 7; six cards 32 designated doctor, one of which is depicted in FIG. 8; six cards 34 designated bureaucrat, one of which is shown in FIG. 9; six cards 36 designated mayor, one of which is shown in FIG. 10; and six cards 38 designated general, one of which is shown in FIG. 11.

As can be seen from FIGS. 1 and 3–11, all of the sets of first cards have first indicia 40, 42, 44, 46, 48, 50, 52, 54, 56, 58, preferably in the form of pictorial representations of the respective occupation. The first indicia designates each card as being a member of a particular one of the ten sets. Thus, the six student cards 20 have the same first indicia 40 on their front faces thereof while the six farmer cards 22 have the same first indicia 42 on the front faces thereof. Similarly, in all of the other sets, the six cards comprising each set have the same first indicia on the front face thereof.

Figure 2:
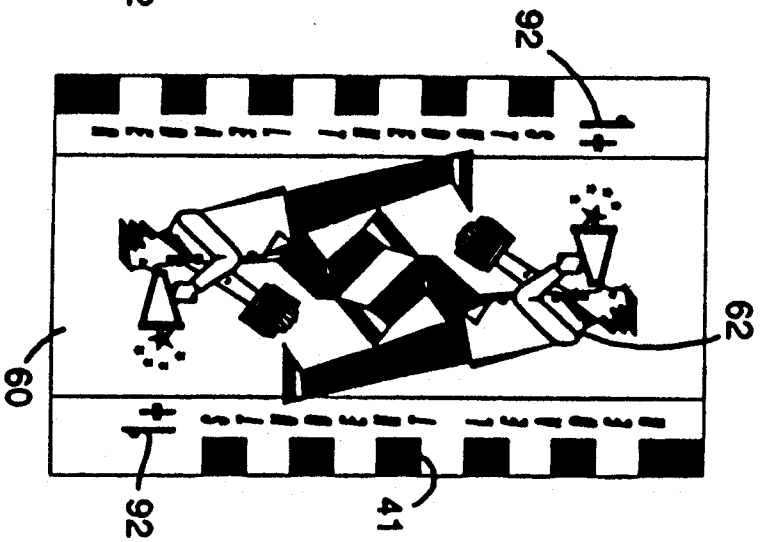
FIG. 2 is a plan view of the front face of a second type of card used in the card game of the present invention.

The second card shown in FIG. 2 is termed a student leader card 60, and that card has first indicia 62 on the front face thereof in the form of a pictorial representation of a student leader.

Figure 12:
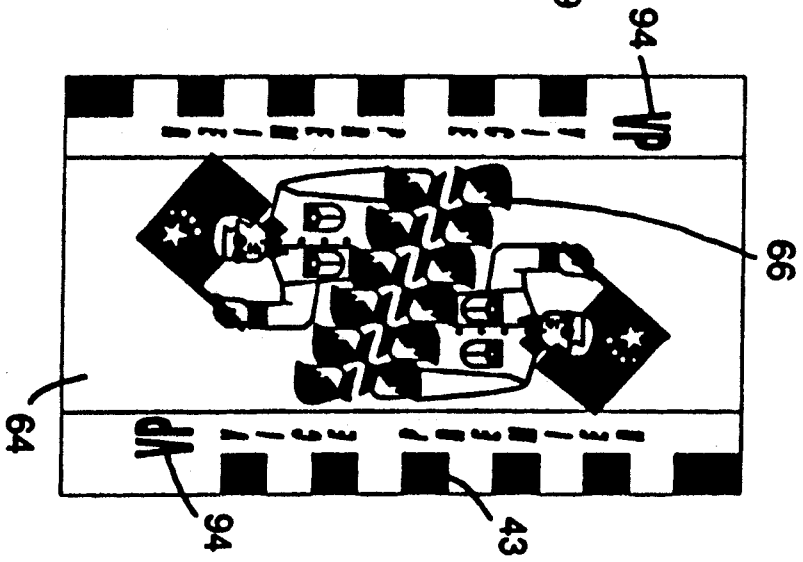
FIG. 12 is a plan view of the front face of a twelfth type of card used in the card game of the present invention.

The two third cards, only one of which is shown in FIG. 12, are designated vice-premier cards and have first indicia 66 on their front faces in the form of a pictorial representation of a vice-premier. Both of the vice-premier cards 64 have the same first indicia 66 on their front faces designating them as being of the same set.

Figure 13:
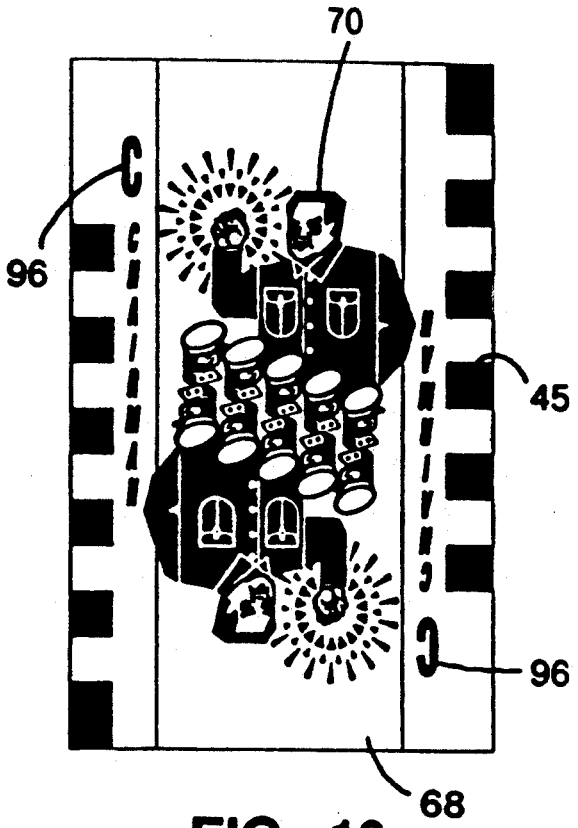
FIG. 13 is a plan view of the front face of a thirteenth type of card used in the card game of the present invention.
Figure 14:
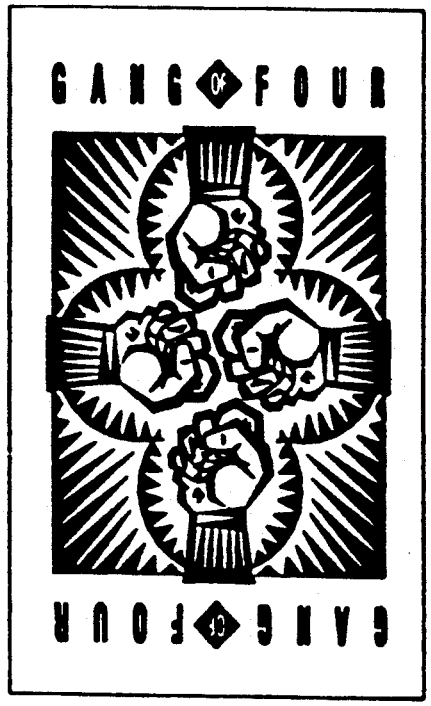
FIG. 14 is a plan view of the rear face of each of the cards illustrated in FIGS. 1–13.

The one fourth card 68 shown in FIG. 13 is designated a chairman card and has first indicia 70 on the front face thereof in the form of a pictorial representation of a chairman.

The rear face of each of the cards illustrated in FIGS. 1–13 can have suitable decorative indicia set forth thereon.

Each of the first cards illustrated in FIGS. 1 and 3–11 also has numerical second indicia 72, 74, 76, 78, 80, 82, 84, 86, 88, 90 on the front face thereof which designates a hierarchical rank of the cards in one set relative to the cards in another set for purposes that will become apparent when the method of play is described. All of the cards in a particular set possess the same numerical second indicia. Thus, all six student cards 20 have the same numerical designation "1" on the face thereof, all six farmer cards 22 have the same numerical designation "2" on the front face thereof, and so on.

The one student leader card 60 illustrated in FIG. 2 includes second indicia 92 in the form of the designation "1+". Also, as seen in FIG. 12, the two vice-premier cards 64 have second indicia 94 on the front face thereof in the form of the designation "VP". Finally, the one chairman card 68 illustrated in FIG. 13 includes second indicia 96 on the front face thereof in the form of the designation "C".

The second indicia, also termed first designating indicia, designates a hierarchical rank of the cards in one set relative to the cards in the other sets. The set of cards having the lowest rank is the student cards 20 having the numerical indicia 72 of "1", the set of cards having the next highest rank is the farmer set of cards 22 having the numerical indicia 74 of "2", and so on. Thus, the sets of cards having successively higher numerical indicia possess higher ranks. The chairman card 68 has the highest rank, while the set of vice-premier cards 64 has the second highest rank. The student leader card 60 illustrated in FIG. 2 is of the same rank as the student cards 20.

The cards in each of the sets of the cards illustrated in FIGS. 1 and 3–11 have third indicia (also termed second designating indicia) 21, 23, 25, 27, 29, 31, 33, 35, 37 and 39 on the face thereof in the form of color indicia. Two of the cards in each of the ten sets of first cards illustrated in FIGS. 1 and 3–11 have red indicia thereon, two of the cards in each set have yellow indicia thereon and two of the cards in each set have blue indicia thereon. The three different colors have a hierarchical rank relative to one another such that red has a higher rank than yellow and yellow has a higher rank than blue. The purpose for that ranking of the colors will become apparent when the method of playing the card game of the present invention is described.

The student leader card 60 illustrated in FIG. 2 also has third indicia 41 on its face thereof. The third indicia 41 on the face of the student leader card 60 can be any color, preferably other than red, yellow or blue. The third indicia on the student leader card can even be multi-color indicia. The third indicia 41 on the student leader card 60 indicates that the student leader card can be any of the three colors (red, yellow, or blue) for purposes of fitting into a flush.

The two vice premier cards 64 can also have third indicia 43 in the form of the same type of color as on the face thereof. It is not necessary that the vice-premier cards be provided with third indicia 43, but if they are, both vice-premier cards 64 should have the same third indicia thereon to designate that both vice-premier cards have the same rank relative to one another.

Finally, the chairman card 68 illustrated in FIG. 13 can also have third indicia 45 on the face thereof although it is not necessary.

To summarize the above description, the following table (also depicted in FIG. 16) is provided which illustrates the composition of the sixty-four cards of the deck.

| CARD RANK* | NAME | NUMBER OF CARDS AND SUITS |
|---|---|---|
| 1 | Students | (Six) 2 red, 2 yellow, 2 blue |
| 1+ | Student Leader | (One) 1 multi-suit |
| 2 | Farmers | (Six) 2 red, 2 yellow, 2 blue |
| 3 | Soldiers | (Six) 2 red, 2 yellow, 2 blue |
| 4 | Factory Workers | (Six) 2 red, 2 yellow, 2 blue |
| 5 | Clerks | (Six) 2 red, 2 yellow, 2 blue |
| 6 | Teachers | (Six) 2 red, 2 yellow, 2 blue |
| 7 | Doctors | (Six) 2 red, 2 yellow, 2 blue |
| 8 | Bureaucrats | (Six) 2 red, 2 yellow, 2 blue |
| 9 | Mayors | (Six) 2 red, 2 yellow, 2 blue |
| 10 | Generals | (Six) 2 red, 2 yellow, 2 blue |
| VP | Vice-Premiers | (Two) N |
| A | | |
| C | Chairman | (One) N |
| A | | |

*from lowest to highest

Figure 15:
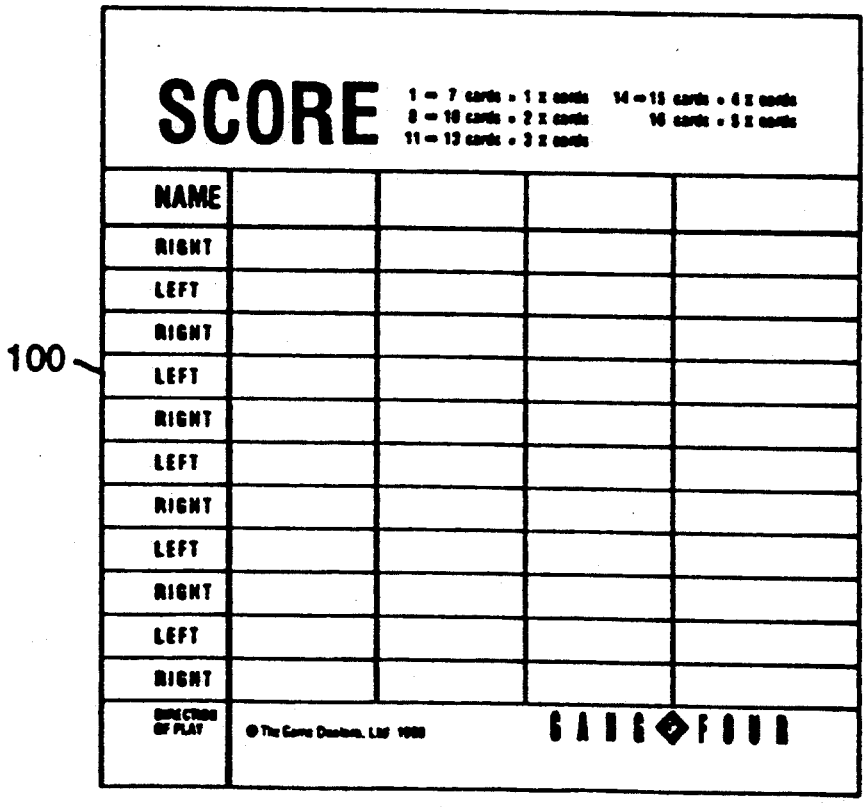
FIG. 15 is a plan view of the front face of a score card used in the card game of the present invention.

As noted above, the game also includes a score pad 100, an exemplary form of which is illustrated in FIG. 15. The use of the score pad will be described in greater detail with reference to the play of the game as described below.

Having described the components of the game, the method of playing the game will now be described. The game is preferably played with four players, although three players can play the game by dealing a blind hand to an imaginary fourth player. The cards of the blind hand are dealt face down and are never viewed during the play of the game.

A game preferably consists of several hands of play. As will become apparent from the description that follows, the number of hands in a game can vary, depending upon several different factors.

To start the game, one of the players is designated as the dealer. For example, as is customary in China, the eldest player can be designated as the dealer for the first hand. Alternatively, the dealer can be designated in any other suitable manner. After the first hand, however, the winner of the previous hand always deals the next hand.

The dealer deals all of the cards of the deck to all the players so that each of the players has sixteen cards. When only three players are playing, the blind hand is also dealt sixteen cards face down. The cards can be dealt out as long as each of the players possesses sixteen cards in his hand at the end of the deal. One possible manner of dealing, as is customary in China, is to deal the cards in a counter-clockwise fashion (i.e., to the right of the dealer).

After all of the cards have been dealt, the first hand is ready to be played. The player having the student leader card 60 in his hand has the opening lead for the first hand, and the card or cards played by the leader in the first hand of the game must contain the student leader card. In each subsequent hand, however, the winner of the previous hand always leads the next hand, and the winner need not play the student leader card in his first play.

Also, the order of play must be determined. The order of play can be determined in any suitable manner. For example, the order of play may be in the same direction as the deal (i.e., counter-clockwise).

To start the play of the first hand, the player with the student leader card must play a card or cards from his hand, including the student leader card 60, that fall within one of the following five categories of cards.

Singles (one card at a time)
Pairs (two-of-a-kind)
Triples (three-of-a-kind
Gang of four (four-of-a-kind)
Five card combination (straights, flushes, full-houses, straight flushes)

Once the first player has played one of the foregoing categories of cards, the next player has the option of either playing one or more cards from his hand or passing. If the next player chooses to play cards from his hand, the cards must be of the same category as the category of cards played by the leader, and the cards must also be of a higher rank. For example, if the leader plays a pair of soldiers (i.e., 3's), the next player must play a pair of cards, and the pair of cards must be of a higher rank. Thus, the next player could play, for example, a pair of clerks (5's). On the other hand, the next player could not play a pair of students (i.e., 2's). Alternatively, as will become clearer from the description that follows, the next player could play a gang of four which is considered to be wild and which can be played on any category at any time. The play continues according to the order of turn with each subsequent player having the option of passing (i.e., knocking) or playing a card or cards from his hand that are of the same category as the category first led, but are of a higher rank. Thus, players attempt to dispose of cards in their hand by playing their cards in category cycles. Once a category is led, subsequent play is restricted to that category (except for the play of a gang of four), and the cycle is not complete until all players have passed. Once all of the players have passed on a given category, the last person to have played a card or cards gets to begin a new cycle by leading any category of his choice. The new category can be the same category just played or a different category.

For example, assume that the first player chooses to play pairs and begins by playing a pair of farmers having a rank of "2". All subsequent play in this cycle must be with pairs, and with pairs of higher rank. Play continues with higher and higher pairs until no player can play on that category or no player chooses to play on that category, and all players pass. Then the last person to have played a pair (the person who has played the highest pair) gets to lead anything of his choice, thus beginning a new category cycle.

Assuming now that the last player to have played chooses to lead a low straight (1, 2, 3, 4, 5), thus beginning a five card category cycle, all subsequent play must now be with higher ranking five card categories. Poker rules govern the five card rankings, so only a higher straight, a flush, a full-house or a straight flush can now be played. Play continues with higher and higher poker hands until all players pass and a new category is begun.

Whenever a player has four-of-a-kind (gang of four) in his hand, it is considered wild and can be played on any category at any time. Fives-of-a-kind, sixes-of-a-kind, and sevens-of-a-kind are also considered wild. Once a gang of four is played, only a higher ranking four-of-a-kind or a five-of-a-kind, six-of-a-kind or seven-of-a-kind can be played on that cycle. Similarly, a higher ranking five-of-a-kind or a six-of-a-kind or seven-of-a-kind must be played if a five-of-a-kind is played and so on.

In playing the game, there are three simple rules of ranking.

1. Color—When all numerical values are equal, color or suit ranks are: red (highest), yellow (second highest), blue (lowest).
2. Timing—first one down rule—subsequent cards laid on a play cannot be exactly the same as the cards previously played, but must be of a higher rank. That is, a vice-premier cannot be played directly on another vice-premier already played. In the same manner, pairs cannot be played on pairs of exactly the same rank and color.
3. Wild cards—a four-of-a-kind (gang of four), five-of-a-kind (gang of five), six-of-a-kind (gang of six), seven-of-a-kind (gang of seven) are always wild, can be played at any time, and can beat any ranked card of any category at any time. Only a higher ranking gang of four (or five-of-a-kind, six-of-a-kind or seven-of-a-kind) can be played on a gang of four. The lowest six-of-a-kind beats the highest ranking five-of-a-kind, and the lowest ranking five-of-a-kind beats the highest ranking gang of four. Because of the student leader card, a gang of four is most probable among students, and it is only among students that a gang of seven is possible.

In determining the higher ranking cards within a particular category, the following rules govern.

RANK WITHIN CATEGORIES

Singles (one card at a time) play

1) The chairman card is the highest ranking single followed by the two vice-premier cards.
2) A student leader is higher in rank than all other student cards but is lower in rank than all of the other cards in the deck.
3) First one down rule: in any given round, identical cards may not be played on each other since players are always required to play higher ranking cards.
4) The chairman may be used only in singles play.

Pairs (two-of-a-kind) play

1) Number rule: higher numbered pairs beat lower numbered pairs.
2) Color rule: a pair of red factory workers, beats a pair of yellow factory workers and a pair of yellow factory workers beats a pair of blue factory workers.
3) The highest ranking card of the pair determines the rank of the whole pair. Thus, a red/yellow pair beats a red/blue pair which beats a yellow/yellow pair which beats a yellow/blue pair which beats a blue/blue pair. When the highest ranking card in each pair is the same, the next highest ranking cards are compared.
4) The vice-premiers can be played together as pairs.

Triples (three-of-a-kind) play

1) Number rule: higher numbered triples beat lower numbered triples.
2) The highest ranking card of the triple determines the rank of the whole triple. For example, three students consisting of one student leader and two blues may win over three students consisting of two reds and one yellow. (It is the highest card, in this case the student leader, which determines the higher ranking of the two.) When the highest ranking card of each triple is the same, the next highest ranking card in each pair is compared.

Five card combination (poker hand) play

1) Poker rules apply. That is, the lowest flush beats the highest straight, the lowest full-house beats the highest flush, and the lowest straight flush beat the highest full-house.
2) A definition and discussion of these five card categories (ranked lowest to highest) follows:

Straight—five cards, in two or more suits, ranking consecutively, for example 8, 7, 6, 5, 4. One straight beats another if it contains a higher ranking card, so that 10, 9, 8, 7, 6 beats 9, 8, 7, 6, 5 and a red 9, 8, 7, 6, 5 beats a yellow 9, 8, 7, 6, 5. The chairman and vice-premiers cannot be used in straights.

Flush—five cards of the same color or suit. One flush beats another if it contains a higher card. For example, a blue flush, 8 high, beats a red flush, 7 high, but it does not beat a yellow flush, also 8 high. If the highest cards are tied (as in flushes of the same color), then the tie is broken by the higher of the next cards in line, so that a yellow 9, 7, 6, 3, 1 can be played on a yellow 9, 7, 6, 1, 1 flush. The chairman and vice-premiers cannot be used in flushes. A special feature of the game is that the student leader can be any color for the purpose of fitting into a flush, but it still retains its rank of 1 for all other play.

Full-house—three cards of one rank and two cards of another rank (a triple and a pair). One full-house beats another if it contains a higher ranking three-of-a-kind. In the case of identical three-of-a-kinds, the pair then determines the higher rank. Vice-premiers can be used in full-houses if they are played as a pair.

Straight flush—five cards of the same suit in sequence. The highest straight flush is 10, 9, 8, 7, 6 of the red suit, and the lowest straight flush is 5, 4, 3, 2, 1 of the blue suit.

Turning back to the play of the game, play continues in the manner described above until one player has played his last card. However, when a player has only one card remaining in his hand, he must declare "Last Card" in order to warn all of the other players that he may be able to go out on the next turn. If a player fails to warn the others by not declaring "Last Card" when he has only one card left in his hand, that player cannot win the hand. That is, the hand continues among the other players until an alternate winner is decided. Obviously, when a player goes out by playing something other than a single (i.e., a pair, a full-house, etc.), no warning is needed.

After a person has declared "Last Card", special rules go into effect for the person playing immediately before him. If the category of cards being played is singles, the person playing immediately before the declarer must always play the highest card in his hand, and he cannot pass if he can play a card. This is the only time in the game when playing a card is not optional. If the player playing immediately before the declarer is in a position to lead a category, he must lead a category other than singles, and if he has only singles in his hand, he must lead with the highest single card in his hand. The last card rules do not apply to the other players unless the player immediately behind them also declares "Last Card".

Once a player has played his last card to end the hand, that player is declared the winner of the hand, and the other players with cards remaining in their hands are assessed points on the basis of how many cards each player has in his hand at the time the winner depletes his hands of cards multiplied by a predetermined factor as set forth in the following schedule.

One to seven cards=one point per card
Eight to ten cards=double the points (2×) points (3×)
Fourteen or fifteen cards=quadruple the points (4×)
Sixteen cards=quintuple the points (5×)

After the first hand is completed and the points for each of the players have been determined, all of the cards are gathered and reshuffled. The winner of the previous hand deals all of the cards to the players, and before play is begun on the new hand, an exchange of cards takes place between the loser of the previous hand and the winner of the previous hand. The loser must give the highest ranking card in his hand to the winner of the previous hand. Thereafter, the winner gives any card of his choice to the loser. Ideally, the winner would give to the loser of the last hand either the lowest ranking card in his hand, or, depending upon the cards in his hand, the card that is of least value to him. Both cards of the exchange are shown to all of the other players.

The loser of the last hand is the player having the most cards in his hand at the end of the last hand. In the case of a tie for the loser of the last hand (i.e., two or three players have the same number of cards left in his hand and no other player has more cards left in their hand), the player with the highest total score so far in the game is designated the loser and is required to give up his best card to the winner of the previous hand. If a tie still exists for the loser of the last hand according to that criteria, than the player closest to the winner, moving in the counter-clockwise direction, is designated the loser.

Since the aforementioned exchange of cards takes place between the winner and the loser of the previous hand, the exchange of cards occurs only after one hand has been played. Thus, there is no exchange of cards on the first hand of the game.

After the exchange of cards, the play of the hand proceeds as described above with the winner of the last hand leading any category of his choice and with each subsequent player who decides to play cards from his hand, playing cards of the same category but of a higher rank.

The players continue to play successive hands, and the game is over when the first player accumulates at least 100 points. The winner of the game is the player with the least number of points at the end of the game.

In playing the game, there are several key rules that must be kept in mind. That is, the play of the cards is always according to the category that is led, and a player must always play higher cards, not identical cards, unless the player is leading. Also, four-(or more) of-a-kind is wild and can be played on any category at any time. Additionally, the chairman card, followed by the two vice-premiers, is the highest ranking card in the deck, and the chairman can be used for play only in the singles category. The vice-premiers can be used for play only in the singles category or the pairs category. Finally, the student leader card fits within any suit for the purposes of flushes. In other words, a flush can consist of a red 9, a red 7, a red 6, a red 4 and the student leader card, or, alternatively, a green 9, a green 7, a green 6, a green 4 and the student leader card.

As can be seen from the foregoing description, the card game of the present invention is different from known card games in several respects. For example, rather than playing cards according to a particular suit, the card game of the present invention requires players to play cards in a particular category. Moreover, in contrast to known games which permit players to play only a single card at a time, the game of the present invention allows players to play more than one card in each play. Also, in the present invention, players are given the option of playing cards rather than being required to play cards, thereby allowing players to strategize as to whether they should play the cards in their hands in one category or another.

The card game of the present invention also does not permit players to pick up discarded cards, and no player wins and keeps discarded cards or tricks. Rather, the object of each player is to deplete his hand as quickly as possible. During the play of the game, all cards that are played are left face up in a pile in the middle of the playing surface, and no touching of or looking at the discarded cards is permitted, thereby requiring players to remember the card that had been played previously.

Because of the manner in which the card game of the present invention is played, strategy can oftentimes play an important part. One of the keys to the game involves the manner in which players arrange the cards in their hand. Preferably, players should arrange the cards in their hand in combinations which allow them to see their options and gain the greatest amount of power from the categories held in their hand. Thus, it is oftentimes advantageous for the players to arrange the cards in their hands by number rank rather than by suit.

For the most part, the hardest cards to discard are the low cards. Thus, it may be advantageous to play a low card when the opportunity presents itself. Alternatively, one of the best ways to discard the low cards is to combine them in flushes and straights.

Because a player leading a new category can lead any category of cards he desires, it is advantageous for the players to attempt to play their cards in such a manner as to obtain the lead. Along that same line, players should attempt to lead categories they have control of so that they can continue to lead. In that way, other players will be forced to break up their hands or risk getting caught with big penalties at the end of the hand if they choose to pass.

Although it is important for each player to arrange the cards in their hands at the beginning of each hand, it is equally important for each player to recognize when the play of the hand is not going his way so that he can rearrange the cards in his hand to participate in the categories being played. For example, if a player possesses a hand that features five card categories but the other players are not leading five card categories, the player may have to break up flushes and even full-houses in order to gain the lead or rid himself of some cards before the end of the hand.

It can be quite advantageous for a player to have the lead toward the end of the game since the other players will most likely have fewer cards to stop him. Therefore, the timing of the use of "winners", such as the wild cards (i.e., the gangs of four) can make a material difference in the outcome of a hand. A person having, for example, only one card left can be prevented from going out by a gang of four, and the player going out may never regain the lead.

Those players having more powerful cards in their hands (high ranking singles, high ranking pairs, a gang of four, etc.) are usually best served by keeping the lead out of the five card combination category. That strategy keeps the other players locked into maintaining big hands while the players with the powerful hands control the play through other categories. Oftentimes, the five card category (i.e., a small straight) can be left until the very end and played after a certain winner (i.e., a card or cards which the player is almost certain will cause the other players to pass) has become evident.

Advanced players can oftentimes determine, by carefully watching the play of cards, when someone is close to going out. In certain instances, it may be advantageous to the advanced player to help that player go out by leading categories that are helpful to the person waiting to go out or by blocking the other players from ridding their hands of cards. The situations in which such a strategy may be advantageous are when a player has less than eight cards in his hand, thereby assuring that he will not be assessed points greater than the number of cards in his hand, and when the other players have a large number of cards in their hands.

The winner of each hand is given three advantages over the other players which make winning a hand very desirable. Those three advantages are: 1) the winner receives an extra high card from the loser of the previous hand; 2) the winner is permitted to discard the worst card in his hand to the loser of the last hand; and, 3) the winner is able to open the lead at the beginning of the hand. Thus, the card game of the present invention is particularly unique in that the stronger tend to get stronger while the weaker tend to get weaker. That is, the winner of the previous hand obtains the three aforementioned advantages while the loser of the last hand has the disadvantage of having to give up his highest card while receiving, most likely, a very low card.

Although the method of playing the card game in the present invention has been described above according to a preferred embodiment, it should be realized that variations may be employed without departing from the spirit of the game. For example, one alternative would be to alternate the direction of play from one hand to the next. In the first hand, play could be in the counterclockwise direction (i.e., to the right) and then during the next hand, the direction of play can switch to the clockwise direction (i.e., to the left). That variation serves to shift the disadvantage away from the one player who is unfortunate enough to be always behind the winner who is keeping the lead.

The score pad 100 shown in FIG. 15 is provided with directional reminders along the left hand column to assist in keeping track of the direction of play. In using the score pad 100, the names of each of the players are entered in the boxes across the top of the score pad. Then, after the first hand of play in which the play was to the right, the score of each player can be entered in the appropriate horizontal arrangement of boxes to the right of the uppermost "RIGHT" designation. Players will then be reminded that in the next hand, the play should be to the left, and at the end of the second hand, the score of each player can be entered in the appropriate box.

It is to be understood that if players choose to play each hand by playing in the same direction, a score pad similar to that shown in FIG. 15 but without the "RIGHT" and "LEFT" designations can be utilized. Alternatively, the score of the game can be kept on a note pad or other suitable piece of paper.

In another alternative, the deal of the cards to the players can be determined according to what is termed the "Chinese cut and deal". The dealer shuffles the deck and the player at the dealer's right cuts the deck. The dealer than cuts the deck and looks at the card to determine with which player the deal will begin. The dealer then counts off each of the players beginning with himself as number one and proceeding counter-clockwise around the table until he reaches the number of the card that was cut. The dealer then begins the deal with that person.

For example, the dealer will be the first person to be dealt a card when the card cut is 1, 5 or 9, the person to the dealer's right will be the first person to be dealt when the card cut is 2, 6 or 10, the player across from the dealer will be the first person to be dealt a card when the card cut is a 3, 7 or vice-premier and the player to the dealer's left will be the first person to be dealt a card when the cut card is a 4, 8 or chairman.

It is also to be understood that the first, second and third indicia on the front face of the cards may be different than that shown in FIGS. 1–13, as long as the ranking of the cards and the suits of the cards is maintained in some manner. It is also to be understood that the game can be provided with a suitable reference device which indicates the hierarchical ranking of the various set of cards relative to one another as well as the hierarchal ranking of the suits relative to one another. The suitable reference sheet can be separate from or incorporated into the rules which accompany the game. Also, it is to be noted that since the cards in each set (i.e., the student cards, the farmer cards, the soldier cards, etc.) possess the same first and second indicia, one of those two types of indicia need not be provided on the cards, as long as there is some type of indicia for distinguishing the rank of the cards relative to the other cards. For example, the first indicia which is a pictorial representation may be removed.

The principles, preferred embodiments and modes of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations, changes and equivalents which follow in the spirit and scope of the present invention as defined in the claims be embraced thereby.

What is claimed is:

1. A card game for play by at least three players in which players play groups of cards that include one or more cards, comprising:

ten sets of first cards, each set including six cards, each of said first cards having first indicia on one face thereof, the cards of the same set having the same first indicia designating the cards as being of a particular set and the first indicia on the cards of different sets being different, each of said first cards also having second indicia on the one face thereof, the cards of the same set having the same second indicia and the cards of different sets having different second indicia, said second indicia designating a rank of the cards in a set relative to the cards of the other sets so that said ten sets of cards are ranked in a hierarchical order, each of said first cards also having third indicia on the one face thereof, said third indicia designating, as between two played groups of cards having the same second indicia, the higher ranking played group, a first pair of cards in each set having the same third indicia on the one face thereof which has a particular rank associated therewith, a second pair of cards in each set having the same third indicia on the one face thereof which has a rank associated therewith that is higher than said particular rank, and a third pair of cards in each set having the same third indicia on the one face thereof which has a rank associated therewith that is lower than said particular rank, the third indicia on the first pair of cards being different and distinguishable from the third indicia on the second and third pairs of cards, the third indicia on the second pair of cards being different and distinguishable from the third indicia on the first and second pairs of cards;

one second card having first indicia on one face thereof for designating the second card as being a member of a specific one of said ten sets, said second card having second indicia on the one face thereof for designating the second card as being of a rank relative to the other cards that is equivalent to the rank of the cards in said specific one set, said second indicia on the second card being different and distinguishable from the second indicia on all of the first cards, said second card also having third indicia on the one face thereof which has a rank associated therewith that is higher than the rank associated with the third indicia on all other cards in said specific one set, said third indicia on said second card being different and distinguishable from the third indicia on all of the first cards;

two third cards having first indicia on one face thereof for designating said two cards as being of a set of cards different from said ten sets of cards and said second card, the first indicia on the third cards being different and distinguishable from the first indicia on the first and second cards, said two third cards having second indicia on the one face thereof for designating the third cards as having a rank that is higher than the rank of each of said ten sets of cards, the second indicia on the third cards being different and distinguishable from the second indicia on the first and second cards, said two third cards having third indicia on the one face thereof designating the cards as being of the same rank relative to each other;

one fourth card having first indicia on one face thereof designating the fourth card as being of a set different from the ten sets, said second card and said third cards, the first indicia on the fourth cards being different and distinguishable from the first indicia on the first, second and third cards, said fourth card having second indicia on the one face thereof for designating the fourth card as having a rank that is higher than the rank of each of said ten sets of cards and higher than the rank of said third cards, the second indicia on the fourth cards being different and distinguishable from the second indicia on the first, second, and third cards; and scoring means for recording the scores of the players for a plurality of hands.

2. The card game according to claim 1, wherein said first indicia on said first cards, said second cards, said third cards and said fourth cards is a pictorial representation of a different occupation.

3. The card game according to claim 1, wherein said second indicia on said first cards and said second cards includes numerical indicia and said second indicia on said third cards and said fourth cards includes alphabetic indicia.

4. The card game according to claim 1, wherein said third indicia on said first cards includes color indicia.

5. A card game for play by a plurality of players in which players play groups of cards that include one or more cards, comprising:

a deck of cards that includes a plurality of first cards divided into at least ten sets such that each set contains first, second and third pairs of cards, each of the first cards having a first rank indicia on one face thereof for designating the cards as being of a particular set and for designating a rank of the cards of one set relative to cards in other sets, all of the cards within a particular set having the same first rank indicia so that all of the cards within a set have the same rank relative to cards in other sets and so that the sets of cards are ranked in a hierarchical order, the first rank indicia on the first cards in each set being different and distinguishable from the first rank indicia on the first cards in the other sets, each of said first cards also having second rank indicia on the one face thereof designating, as between two played groups of cards having the same first rank indicia, the higher ranking played group, some of the cards within a respective set having different second rank indicia and the different second rank indicia being ranked according to a hierarchical order, the first pair of cards in each set having the same second rank indicia, the second pair of cards in each set having the same second rank indicia, the third pair of cards in each set having the same second rank indicia, the second rank indicia on the first pair of cards in a set being different and distinguishable from the second rank indicia on the cards in the second and third pairs of cards in the respective set, the second rank indicia on the second pair of cards in each set being different and distinguishable from the second rank indicia on the cards in the first and third pairs of cards in the respective set, said cards being arrangeable into said groups, one of said groups being a wild group that can be played at any time and that has a rank higher than all other groups, said wind group including at least four cards which have the same first rank indicia on the one face thereof.

6. The card game according to claim 5, wherein said deck of cards includes one second card having first rank indicia on one face thereof designating the second card as having a rank relative to the sets of first cards that is equal to the rank of one specific set of first cards, the first rank indicia on the second card being different and distinguishable from the first rank indicia on all of the first cards, said second card having second rank indicia on the one face thereof that is different and distinguishable from the second rank indicia on all of said first cards in said one specific set of cards, said second rank indicia on said second card having a rank associated therewith that is higher than the rank associated with all of the cards in said one specific set of cards.

7. The card game according to claim 6, wherein said deck of cards includes two third cards, said two third cards having first rank indicia on one face thereof designating the two third cards as being of the same set and as having a rank relative to the plurality of sets of first cards that is higher than the rank of all said plurality of sets of first cards, said first rank indicia on said two third cards being distinguishable from the first rank indicia on all of said first cards and said second cards.

8. The card game according to claim 7, wherein said deck of cards includes one fourth card having first rank indicia on one face thereof designating the fourth card as having a rank relative to the sets of first cards and the third cards that is higher than the rank of said sets of first cards and said third cards, the first rank indicia on the fourth card being different and distinguishable from the first rank indicia on the first cards, the second card and the third cards.

9. The card game according to claim 5, including scoring means for recording the score of the players.

10. A card game for play by a plurality of players in which players play groups of cards that include one or more cards, comprising:

a plurality of first cards divided into a plurality of sets, each set including a plurality of first cards, each of said first cards having first designating indicia on one face thereof for designating the cards as being of a particular set and for designating a rank of the cards on one set relative to cards in other sets, all of the cards within a particular set having the same first designating indicia so that all of the cards within a set have the same rank relative to cards in other sets and so that the sets of cards are ranked in a hierarchical order, the cards of different sets having different first designating indicia, each set of cards including six first cards, said first cards being arrangeable into said groups, one of said groups being a wild group that can be played at any time and that has a rank higher than all other groups, said wild group including at least four cards which have the same first designating indicia on the one face thereof; and determining means for determining, as between two played groups of cards having the same first designating indicia on the faces thereof, the higher ranking played group, said determining means determining the higher ranking played group independently of any other played groups of cards, said determining means including second designating indicia on the one face of each of the first cards and a reference document which correlates the second designating indicia to a hierarchical ranking scheme, three of the first cards of each set having different and distinguishable second designating indicia and each different and distinguishable second designating indicia being set forth on two first cards in each set, the different and distinguishable second designating indicia on the first cards of each set being the same as the different and distinguishable second designating indicia on the first cards of each other set.

11. The card game according to claim 10, including three different second designating indicia, each of the three second designating indicia having a different rank associated therewith.

12. The card game according to claim 11, including one additional card having first designating indicia on one face thereof designating the additional card as being a member of a specific one of said sets of first cards, the first designating indicia on the one additional card being different and distinguishable from the first designating indicia on all of the first cards, said one additional card having second designating indicia on the one face thereof having a rank associated therewith that is higher than the rank associated with the second designating indicia on all other cards in said specific one set, said second designating indicia on the one additional card being different and distinguishable from the second designating indicia on all of the first cards.

13. The card game according to claim 11, including two additional cards which have first designating indicia on one face thereof for designating the two additional cards as being of a set different from all of said sets of first cards, the first designating indicia on said two additional cards being different and distinguishable from the first designating indicia on all of said first cards.

14. The card game according to claim 11, including one additional card having first designating indicia that is different and distinguishable from the first designating indicia on all of said sets of first cards.

15. The card game according to claim 10, wherein said plurality of first cards includes ten sets of cards, each set including six first cards, and said wild group including five cards which have the same first designating indicia on the one face thereof and six cards which have the same first designating indicia on the one face thereof.

16. The card game according to claim 10, wherein said determining means includes a reference document which correlates the second designating indicia to a ranking scheme.

* * * * *